US009520140B2

(12) United States Patent
Goesnar et al.

(10) Patent No.: US 9,520,140 B2
(45) Date of Patent: Dec. 13, 2016

(54) SPEECH DEREVERBERATION METHODS, DEVICES AND SYSTEMS

(71) Applicant: DOLBY LABORATORIES LICENSING CORPORATION, San Francisco, CA (US)

(72) Inventors: Erwin Goesnar, Daly City, CA (US); Glenn N. Dickins, Como (AU); David Gunawan, Sydney (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/782,746

(22) PCT Filed: Mar. 31, 2014

(86) PCT No.: PCT/US2014/032407

§ 371 (c)(1),
(2) Date: Oct. 6, 2015

(87) PCT Pub. No.: WO2014/168777

PCT Pub. Date: Oct. 16, 2014

(65) Prior Publication Data

US 2016/0035367 A1 Feb. 4, 2016

Related U.S. Application Data

(60) Provisional application No. 61/810,437, filed on Apr. 10, 2013, provisional application No. 61/840,744, filed on Jun. 28, 2013.

(51) Int. Cl.
*G10L 21/0232* (2013.01)
*G10L 21/0208* (2013.01)
(Continued)

(52) U.S. Cl.
CPC ..... *G10L 21/0232* (2013.01); *G10L 21/0208* (2013.01); *G10L 25/18* (2013.01); *G10L 25/21* (2013.01); *G10L 2021/02082* (2013.01)

(58) Field of Classification Search
CPC ..... G10L 21/0208; G10L 2021/02082; G10L 25/18
See application file for complete search history.

(56) References Cited

U.S. PATENT DOCUMENTS 3,542,954 A 11/1970 Flanagan
3,786,188 A 1/1974 Allen
(Continued)

FOREIGN PATENT DOCUMENTS

DE 10016619 12/2001
WO 99/48085 9/1999
(Continued)

OTHER PUBLICATIONS

Avendano, C. et al "Study on the Dereverberation of Speech Based on Temporal Envelope Filtering" Fourth International Conference on Spoken Language, pp. 889-892, vol. 2, Oct. 3-6, 1996.
(Continued)

*Primary Examiner* — Eric Yen

(57) ABSTRACT

Improved audio data processing method and systems are provided. Some implementations involve dividing frequency domain audio data into a plurality of subbands and determining amplitude modulation signal values for each of the plurality of subbands. A band-pass filter may be applied to the amplitude modulation signal values in each subband, to produce band-pass filtered amplitude modulation signal values for each subband. The band-pass filter may have a central frequency that exceeds an average cadence of human speech. A gain may be determined for each subband based, at least in part, on a function of the amplitude modulation
(Continued)

signal values and the band-pass filtered amplitude modulation signal values. The determined gain may be applied to each subband.

20 Claims, 14 Drawing Sheets

(51) Int. Cl.
*G10L 25/18* (2013.01)
*G10L 25/21* (2013.01)

(56) References Cited

U.S. PATENT DOCUMENTS 4,520,500 A * 5/1985 Mizuno ..... G10L 15/00 704/248
5,150,413 A 9/1992 Nakatani
5,255,340 A * 10/1993 Arnaud ..... H04J 3/175 379/351
5,502,747 A 3/1996 McGrath
5,548,642 A 8/1996 Diethorn
5,574,824 A * 11/1996 Slyh ..... G10L 21/0208 704/220
5,768,473 A * 6/1998 Eatwell ..... G10L 21/0208 381/94.1
6,134,322 A 10/2000 Hoege
6,526,385 B1 * 2/2003 Kobayashi ..... G10L 19/018 348/423.1
7,319,770 B2 1/2008 Roeck
7,916,876 B1 * 3/2011 Helsloot ..... G10L 21/038 381/61
8,036,767 B2 10/2011 Soulodre
8,098,848 B2 1/2012 Haulick
8,160,262 B2 4/2012 Buck
8,189,810 B2 5/2012 Wolff
8,218,780 B2 7/2012 Baran
8,284,947 B2 10/2012 Giesbrecht
2004/0260544 A1 * 12/2004 Kikumoto ..... G10H 1/125 704/221
2007/0100610 A1 * 5/2007 Disch ..... G10L 19/0212 704/212
2007/0147623 A1 * 6/2007 Kim ..... G10L 19/008 381/19
2007/0208569 A1 * 9/2007 Subramanian ..... G10L 19/0018 704/270
2008/0208575 A1 * 8/2008 Laaksonen ..... G10L 21/038 704/225
2008/0292108 A1 11/2008 Buck
2010/0017205 A1 1/2010 Visser
2010/0208904 A1 8/2010 Nakajima
2010/0246844 A1 9/2010 Wolff
2010/0262421 A1 * 10/2010 Chong ..... G10L 19/008 704/203
2010/0296668 A1 11/2010 Lee
2011/0002473 A1 1/2011 Nakatani
2011/0004479 A1 * 1/2011 Ekstrand ..... G10L 19/022 704/500
2011/0038489 A1 2/2011 Visser
2011/0096942 A1 4/2011 Thyssen
2011/0137659 A1 * 6/2011 Honma ..... G10L 21/038 704/500
2011/0293103 A1 12/2011 Park
2012/0046955 A1 * 2/2012 Rajendran ..... G10L 19/028 704/500
2012/0130713 A1 5/2012 Shin
2013/0182862 A1 * 7/2013 Disch ..... G10H 1/08 381/61
2014/0200899 A1 * 7/2014 Yamamoto ..... G10L 19/265 704/500
2015/0248889 A1 9/2015 Dickins

FOREIGN PATENT DOCUMENTS

WO 00/60830 10/2000
WO 2014/046923 3/2014

OTHER PUBLICATIONS

Elhilali, M. et al "A Spectro-Temporal Modulation Index (STMI) for Assessment of Speech Intelligibility", Speech Communication, vol. 41, Issues 2-3, Oct. 2003, pp. 331-348.
Jinachitra, P. et al "Towards Speech Recognition Oriented Dereverberation" IEEE ICASSP 2005, I-437-I-440.
Shi, G. et al "Subband Dereverberation Algorithm for Noisy Environments" IEEE International Conference on Emerging Signal Processing Applications, Jan. 12-14, 2012, pp. 127-130.
Habets, E. et al "Temporal Selective Dereverberation of Noisy Speech Using One Microphone" IEEE International Conference on Acoustics, Speech, and Signal Processing, Mar. 31, 2008-Apr. 4, 2008, pp. 4577-4580.
Seltzer, M. et al "Subband Likelihood-Maximizing Beamforming for Speech Recognition in Reverberant Environments" IEEE Transactions on Audio, Speech, and Language Processing, vol. 14, No. 6, Nov. 2006, pp. 2109-2121.
Tsilfidis, A. et al "Blind Single-Channel Suppression of Late Reverberation Based on Perceptual Reverberation Modeling" J. Acoustical Society Am. 129, 2011, pp. 1439-1451.
Krishnamoorthy, P. et al "Reverberant Speech Enhancement by Temporal and Spectral Processing" IEEE Transactions on Audio, Speech, and Language Processing, pp. 253-266,vol. 17, No. 2, Feb. 2009.
Kumar, Kshitiz, "A Spectro-Temporal Framework for Compensation of Reverberation for Speech Recognition" Carnegie Mellon University, May 2011.
Tonelli, M. et al "A Maximum Likelihood Approach to Blind Audio De-Reverberation" Proc. of the 7th Int. Conference on Digital Audio Effects, Naples, Italy, Oct. 5-8, 2004, pp. 256-261.
Kleinschmidt, Michael, "Robust Speech Recognition Based on Spectro-Temporal Processing" Sep. 1971.
Garre, V. et al "An Acoustic Echo Cancellation System Based on Adaptive Algorithms" Master Thesis Electrical Engineering, Oct. 2012, Blekinge Institute of Technology.
Arai, T. et al "Using Steady-State Suppression to Improve Speech Intelligibility in Reverberant Environments for Elderly Listeners" IEEE Transactions on Audio, Speech, and Language Processing, vol. 18, No. 7, Sep. 1, 2010, pp. 1775-1780.
Cong-Thanh Do, et al "On the Recognition of Cochlear Implant-Like Spectrally Reduced Speech with MFCC and HMM-Based ASR" IEEE Transactions on Audio, Speech and Language Processing, vol. 18, No. 5, Jul. 1, 2010, pp. 1065-1068.
Soulodre, G. et al "Objective Measures of Loudness" AES, presented at the 115th Conventiion, Oct. 10-13, 2003, New York, New York.

* cited by examiner

900

SPEECH DEREVERBERATION METHODS, DEVICES AND SYSTEMS

CROSS REFERENCE TO RELATED APPLICATIONS

This application claims priority to U.S. Provisional Patent Application No. 61/810,437, filed on 10 Apr. 2013 and U.S. Provisional Patent Application No. 61/840,744, filed on 28 Jun. 2013, each of which is hereby incorporated by reference in its entirety.

TECHNICAL FIELD

This disclosure relates to the processing of audio signals. In particular, this disclosure relates to processing audio signals for telecommunications, including but not limited to processing audio signals for teleconferencing or video conferencing.

BACKGROUND

In telecommunications, it is often necessary to capture the voice of participants who are not located near a microphone. In such cases, the effects of direct acoustic reflections and subsequent room reverberation can adversely affect intelligibility. In the case of spatial capture systems, this reverberation can be perceptually separated from the direct sound (at least to some extent) by the human auditory processing system. In practice, such spatial reverberation can improve the user experience when auditioned over a multi-channel rendering, and there is some evidence to suggest that the reverberation can help the separation and anchoring of sound sources in the performance space. However, when a signal is collapsed, exported as a mono or single channel, and/or reduced in bandwidth, the effect of reverberation is generally more difficult for the human auditory processing system to manage. Accordingly, improved audio processing methods would be desirable.

SUMMARY

According to some implementations described herein, a method may involve receiving a signal that includes frequency domain audio data and applying a filterbank to the frequency domain audio data to produce frequency domain audio data in a plurality of subbands. The method may involve determining amplitude modulation signal values for the frequency domain audio data in each subband and applying a band-pass filter to the amplitude modulation signal values in each subband to produce band-pass filtered amplitude modulation signal values for each subband. The band-pass filter may have a central frequency that exceeds an average cadence of human speech.

The method may involve determining a gain for each subband based, at least in part, on a function of the amplitude modulation signal values and the band-pass filtered amplitude modulation signal values. The method may involve applying a determined gain to each subband. The process of determining amplitude modulation signal values may involve determining log power values for the frequency domain audio data in each subband.

In some implementations, a band-pass filter for a lower-frequency subband may pass a larger frequency range than a band-pass filter for a higher-frequency subband. The band-pass filter for each subband may have a central frequency in the range of 10-20 Hz. In some implementations, the band-pass filter for each subband may have a central frequency of approximately 15 Hz.

The function may include an expression in the form of $R10^A$. R may be proportional to the band-pass filtered amplitude modulation signal value divided by the amplitude modulation signal value of each sample in a subband. "A" may be proportional to the amplitude modulation signal value minus the band-pass filtered amplitude modulation signal value of each sample in a subband. In some implementations, A may include a constant that indicates a rate of suppression. Determining the gain may involve determining whether to apply a gain value produced by the expression in the form of $R10^A$ or a maximum suppression value. The method may involve determining a diffusivity of an object and determining the maximum suppression value for the object based, at least in part, on the diffusivity. In some implementations, relatively higher max suppression values may be determined for relatively more diffuse objects.

In some examples, the process of applying the filterbank may involve producing frequency domain audio data for a number subbands in the range of 5-10. In other implementations, wherein the process of applying the filterbank may involve producing frequency domain audio data for a number subbands in the range of 10-40, or in some other range.

The method may involve applying a smoothing function after applying the determined gain to each subband. The method also may involve receiving a signal that includes time domain audio data and transforming the time domain audio data into the frequency domain audio data.

According to some implementations, these methods and/or other methods may be implemented via one or more non-transitory media having software stored thereon. The software may include instructions for controlling one or more devices to perform such methods, at least in part.

According to some implementations described herein, an apparatus may include an interface system and a logic system. The logic system may include a general purpose single- or multi-chip processor, a digital signal processor (DSP), an application specific integrated circuit (ASIC), a field programmable gate array (FPGA) or other programmable logic device, discrete gate or transistor logic, discrete hardware components and/or combinations thereof.

The interface system may include a network interface. Some implementations include a memory device. The interface system may include an interface between the logic system and the memory device.

According to some implementations, the logic system may be capable of performing the following operations: receiving a signal that includes frequency domain audio data; applying a filterbank to the frequency domain audio data to produce frequency domain audio data in a plurality of subbands; determining amplitude modulation signal values for the frequency domain audio data in each subband; and applying a band-pass filter to the amplitude modulation signal values in each subband to produce band-pass filtered amplitude modulation signal values for each subband. The band-pass filter may have a central frequency that exceeds an average cadence of human speech.

The logic system also may be capable of determining a gain for each subband based, at least in part, on a function of the amplitude modulation signal values and the band-pass filtered amplitude modulation signal values. The logic system also may be capable of applying a determined gain to each subband. The logic system may be further capable of applying a smoothing function after applying the determined gain to each subband. The logic system may be further capable of receiving a signal that includes time domain audio data and transforming the time domain audio data into the frequency domain audio data.

The process of determining amplitude modulation signal values may involve determining log power values for the frequency domain audio data in each subband. A band-pass filter for a lower-frequency subband may pass a larger frequency range than a band-pass filter for a higher-frequency subband. The band-pass filter for each subband may have a central frequency in the range of 10-20 Hz. For example, the band-pass filter for each subband may have a central frequency of approximately 15 Hz.

In some implementations, the function may include an expression in the form of $R10^A$. R may be proportional to the band-pass filtered amplitude modulation signal value divided by the amplitude modulation signal value of each sample in a subband. "A" may be proportional to the amplitude modulation signal value minus the band-pass filtered amplitude modulation signal value of each sample in a subband. "A" may include a constant that indicates a rate of suppression. Determining the gain may involve determining whether to apply a gain value produced by the expression in the form of $R10^A$ or a maximum suppression value.

The logic system may be further capable of determining a diffusivity of an object and determining the maximum suppression value for the object based, at least in part, on the diffusivity. Relatively higher max suppression values may be determined for relatively more diffuse objects.

The process of applying the filterbank may involve producing frequency domain audio data for a number subbands in the range of 5-10. Alternatively, the process of applying the filterbank may involve producing frequency domain audio data for a number subbands in the range of 10-40, or in some other range.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular sound capture and reproduction environments, the teachings herein are widely applicable to other known sound capture and reproduction environments, as well as sound capture and reproduction environments that may be introduced in the future. Similarly, whereas examples of speaker configurations, microphone configurations, etc., are provided herein, other implementations are contemplated by the inventors. Moreover, the described embodiments may be implemented in a variety of hardware, software, firmware, etc. Accordingly, the teachings of this disclosure are not intended to be limited to the implementations shown in the figures and/or described herein, but instead have wide applicability.

Figure 1:
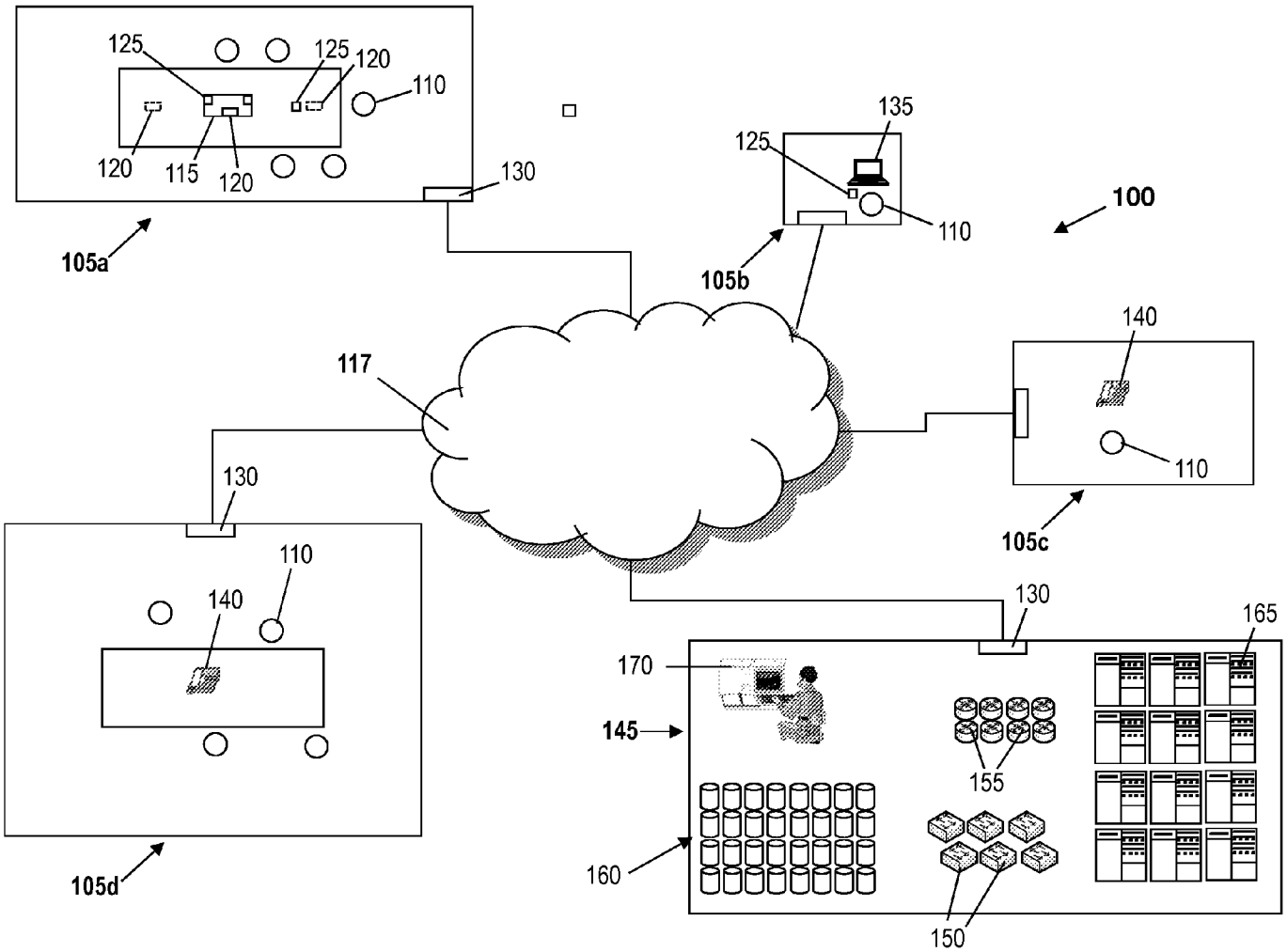
FIG. 1 shows examples of elements of a teleconferencing system.

FIG. 1 shows examples of elements of a teleconferencing system. In this example, a teleconference is taking place between participants in locations 105*a*, 105*b*, 105*c* and 105*d*. In this example, each of the locations 105*a*-105*d* has a different speaker configuration and a different microphone configuration. Moreover, each of the locations 105*a*-105*d* includes a room having a different size and different acoustical properties. Therefore, each of the locations 105*a*-105*d* will tend to produce different acoustic reflection and room reverberation effects.

For example, the location 105*a* is a conference room in which multiple participants 110 are participating in the teleconference via a teleconference phone 115. The participants 110 are positioned at varying distances from the teleconference phone 115. The teleconference phone 115 includes a speaker 120, two internal microphones 125 and an external microphone 125. The conference room also includes two ceiling-mounted speakers 120, which are shown in dashed lines.

Each of the locations 105*a*-105*d* is configured for communication with at least one of the networks 117 via a gateway 130. In this example, the networks 117 include the public switched telephone network (PSTN) and the Internet.

At the location 105*b*, a single participant 110 is participating via a laptop 135, via a Voice over Internet Protocol (VoIP) connection. The laptop 135 includes stereophonic speakers, but the participant 110 is using a single microphone 125. The location 105*b* is a small home office in this example.

The location 105*c* is an office, in which a single participant 110 is using a desktop telephone 140. The location 105*d* is another conference room, in which multiple participants 110 are using a similar desktop telephone 140. In this example, the desktop telephones 140 have only a single microphone. The participants 110 are positioned at varying distances from the desktop telephone 140. The conference room in the location 105*d* has a different aspect ratio from that of the conference room in the location 105*a*. Moreover, the walls have different acoustical properties.

The teleconferencing enterprise 145 includes various devices that may be configured to provide teleconferencing services via the networks 117. Accordingly, the teleconferencing enterprise 145 is configured for communication with the networks 117 via the gateway 130. Switches 150 and routers 155 may be configured to provide network connectivity for devices of the teleconferencing enterprise 145, including storage devices 160, servers 165 and workstations 170.

In the example shown in FIG. 1, some teleconference participants 110 are in locations with multiple-microphone "spatial" capture systems and multi-speaker reproduction systems, which may be multi-channel reproduction systems. However, other teleconference participants 110 are participating in the teleconference by using a single microphone and/or a single speaker. Accordingly, in this example the system 100 is capable of managing both mono and spatial endpoints. In some implementations, the system 100 may be configured to provide both a representation of the reverberation of the captured audio (for spatial/multi-channel delivery), as well as a clean signal in which reverb can be suppressed to improve intelligibility (for mono delivery).

Some implementations described herein can provide a time-varying and/or frequency-varying suppression gain profile that is robust and effective at decreasing the perceived reverberation for speech at a distance. Some such methods have been shown to be subjectively plausible for voice at varying distances from a microphone and for varying room characteristics, as well as being robust to noise and non-voice acoustic events. Some such implementations may operate on a single-channel input or a mix-down of a spatial input, and therefore may be applicable to a wide range of telephony applications. By adjusting the depth of gain suppression, some implementations described herein may be applied to both mono and spatial signals to varying degrees.

The theoretical basis for some implementations will now be described with reference to FIGS. 2-8B. The particular details provided with reference to these and other figures are merely made by way of example. Many of the figures in this application are presented in a figurative or conceptual form well suited to teaching and explanation of the disclosed implementations. Towards this goal, certain aspects of the figures are emphasized or stylized for better visual and idea clarity. For example, the higher-level detail of audio signals, such as speech and reverberation signals, is generally extraneous to the disclosed implementations. Such finer details of speech and reverberation signals are generally known to those of skill in the art. Therefore, the figures should not be read literally with a focus on the exact values or indications of the figures.

Figure 2:
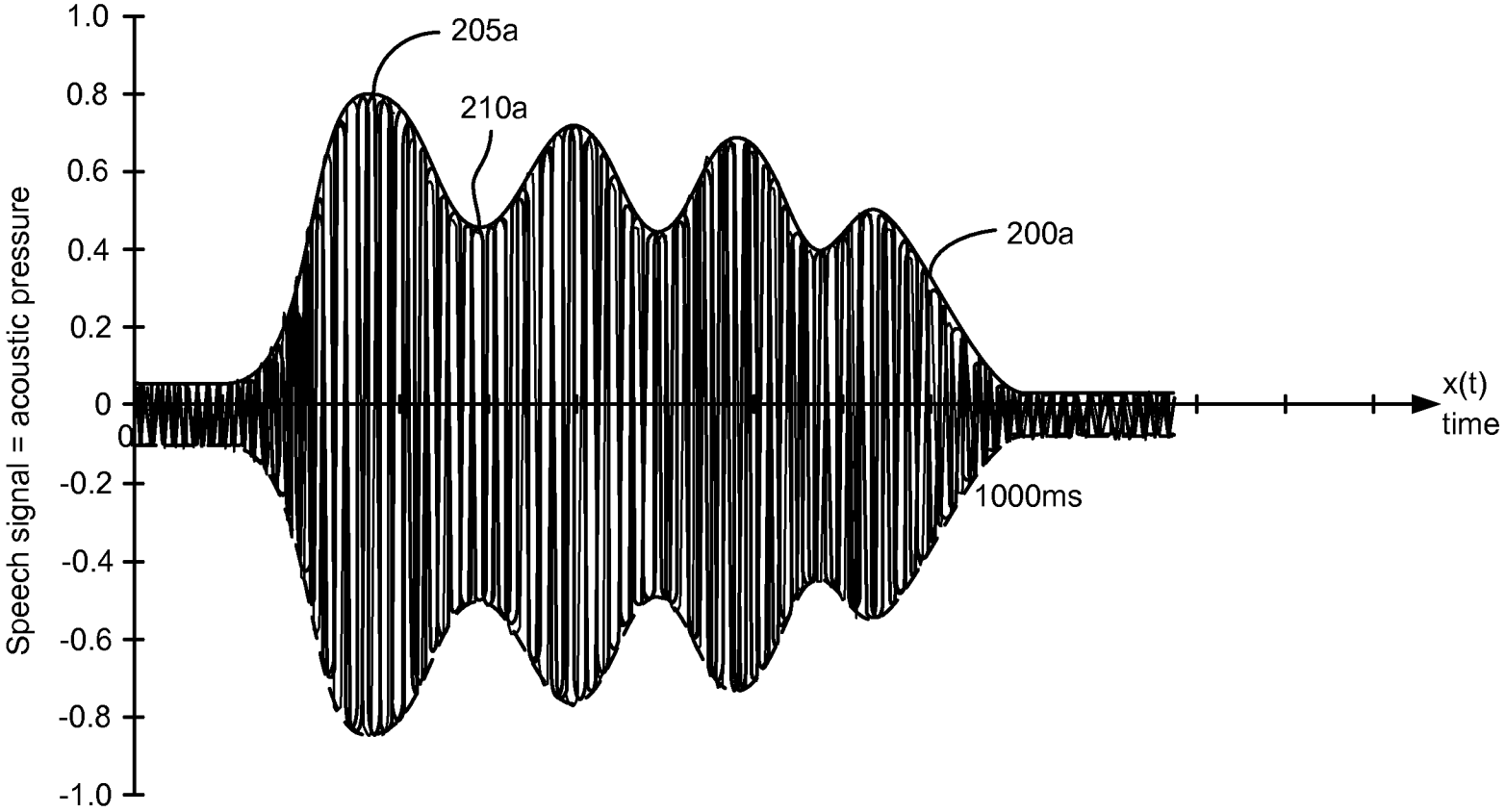
FIG. 2 is a graph of the acoustic pressure of one example of a broadband speech signal.

FIG. 2 is a graph of the acoustic pressure of one example of a broadband speech signal. The speech signal is in the time domain. Therefore, the horizontal axis represents time. The vertical axis represents an arbitrary scale for the signal that is derived from the variations in acoustic pressure at some microphone or acoustic detector. In this case, we may think of the scale of the vertical axis as representing the domain of a digital signal where the voice has been appropriately leveled to fall in the range of fixed point quantized digital signals, for example as in pulse-code modulation (PCM) encoded audio. This signal represents a physical activity that is often characterized by pascals (Pa), an SI unit for pressure, or more specifically the variations in pressure measured in Pa around the average atmospheric pressure. General and comfortable speech activity would be generally be in the range of 1-100 mPa (0.001-0.1 Pa). Speech level may also be reported in an average intensity scale such as dB SPL which references to 20 μPa. Therefore, conversational speech at 40-60 dB SPL represents 2-20 mPa. We would generally see digital signals from a microphone after leveling matched to capture at least 30-80 dB SPL. In this example, the speech signal has been sampled at 32 kHz. Accordingly, the amplitude modulation curve 200*a* represents an envelope of the amplitude of speech signals in the range of 0-16 kHz.

Figure 3:
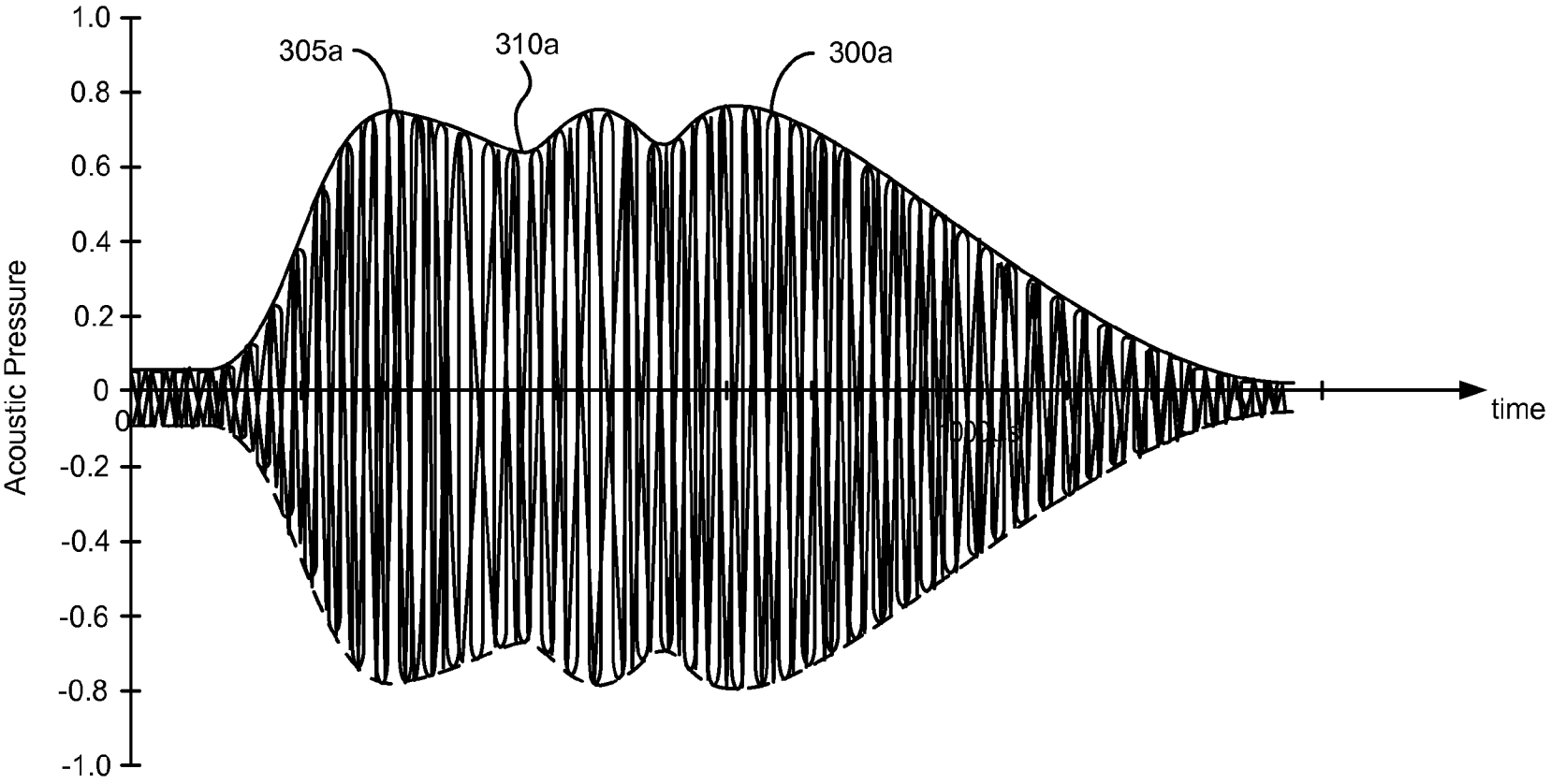
FIG. 3 is a graph of the acoustic pressure of the speech signal represented in FIG. 2, combined with an example of reverberation signals.

FIG. 3 is a graph of the acoustic pressure of the speech signal represented in FIG. 2, combined with an example of reverberation signals. Accordingly, the amplitude modulation curve 300*a* represents an envelope of the amplitude of speech signals in the range of 0-16 kHz, plus reverberation signals resulting from the interaction of the speech signals with a particular environment, e.g., with the walls, ceiling, floor, people and objects in a particular room. By comparing the amplitude modulation curve 300*a* with the amplitude modulation curve 200*a*, it may be observed that the amplitude modulation curve 300*a* is smoother: the acoustic pressure difference between the peaks 205*a* and the troughs 210*a* of the speech signals is greater than that of the acoustic pressure difference between the peaks 305*a* and the troughs 310*a* of the combined speech and reverberation signals.

Figure 4:
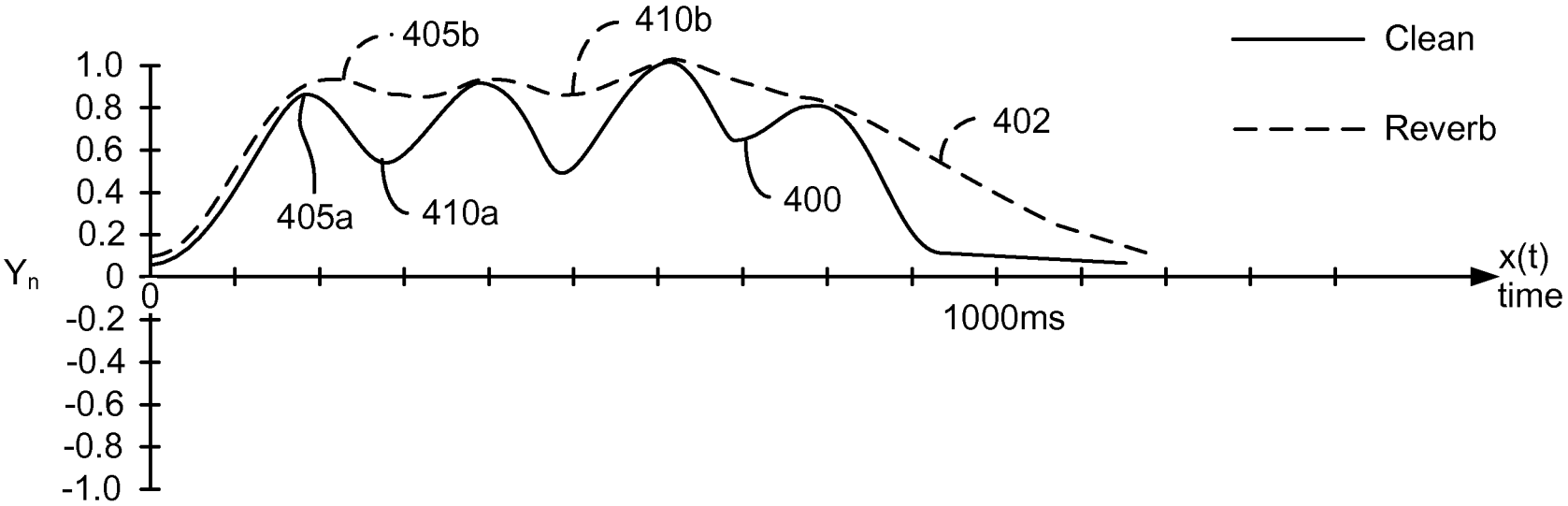
FIG. 4 is a graph of the power of the speech signals of FIG. 2 and the power of the combined speech and reverberation signals of FIG. 3.

In order to isolate the "envelopes" represented by the amplitude modulation curve 200*a* and the amplitude modulation curve 300*a*, one may calculate power $Y_n$ of the speech signal and the combined speech and reverberation signals, e.g., by determining the energy in each of n time samples. FIG. 4 is a graph of the power of the speech signals of FIG. 2 and the power of the combined speech and reverberation signals of FIG. 3. The power curve 400 corresponds with the amplitude modulation curve 200*a* of the "clean" speech signal, whereas the power curve 402 corresponds with the amplitude modulation curve 300*a* of the combined speech and reverberation signals. By comparing the power curve 400 with the power curve 402, it may be observed that the power curve 402 is smoother: the power difference between the peaks 405*a* and the troughs 410*a* of the speech signals is greater than that of the power difference between the peaks 405*b* and the troughs 410*b* of the combined speech and reverberation signals. It is noted in the figures that the signal comprising voice and reverberation may exhibit a similar fast "attack" or onset to the original signal, whereas the trailing edge or decay of the envelope may be significantly extended due to the addition of reverberant energy.

Figure 5:
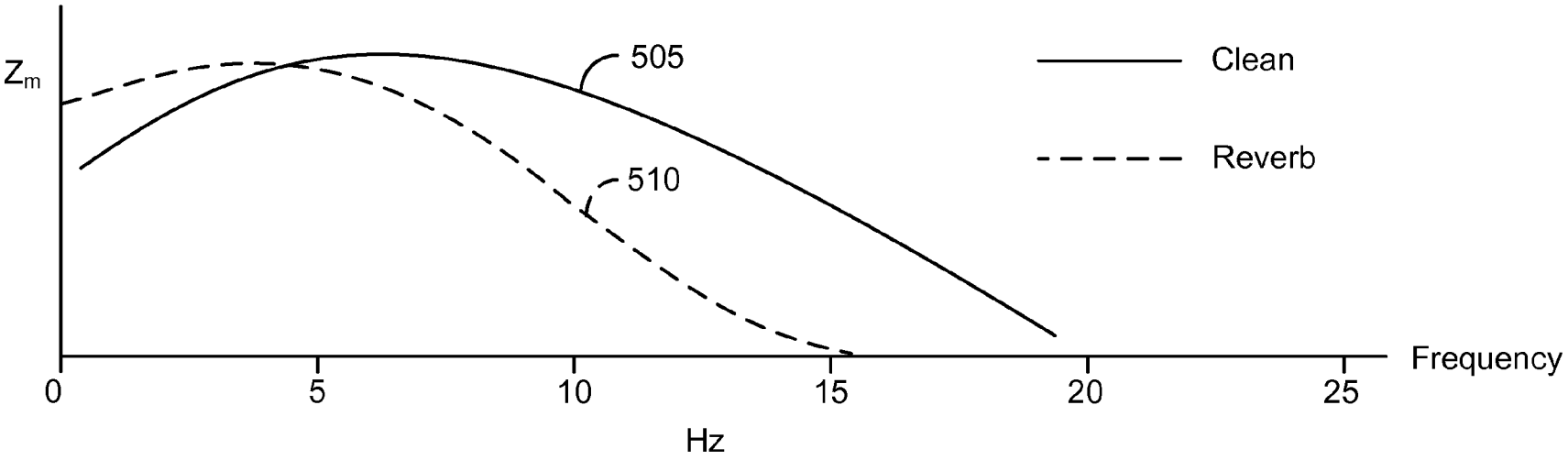
FIG. 5 is a graph that indicates the power curves of FIG. 4 after being transformed into the frequency domain.

FIG. 5 is a graph that indicates the power curves of FIG. 4 after being transformed into the frequency domain. Various types of algorithms may be used for this transform. In this example, the transform is a fast Fourier transform (FFT) that is made according to the following equation:

$$Z_m=\Sigma_{n=1}^{N}Y_n e^{-i2\pi mn/N}, m=1 \ldots N \qquad \text{(Equation 1)}$$

In Equation 1, n represents time samples, N represents a total number of the time samples and m represents a number of outputs $Z_m$. Equation 1 is presented in terms of a discrete transform of the signal. It is noted that the process of generating the set of banded amplitudes ($Y_n$) is occurring at a rate related to the initial transform or frequency domain block rate (for example 20 ms). Therefore, the terms $Z_m$ can be interpreted in terms of a frequency associated with the underlying sampling rate of the amplitude (20 ms, in this example). In this way $Z_m$ can be plotted against a physically relevant frequency scale (Hz). The details of such are mapping are well known in the art and provide greater clarity when used on the plots.

The curve 505 represents the frequency content of the power curve 400, which corresponds with the amplitude modulation curve 200*a* of the clean speech signal. The curve 510 represents the frequency content of the power curve 402, which corresponds with the amplitude modulation curve 300*a* of the combined speech and reverberation signals. As such, the curves 505 and 510 may be thought of as representing the frequency content of the corresponding amplitude modulation spectra.

It may be observed that the curve 505 reaches a peak between 5 and 10 Hz. This is typical of the average cadence of human speech, which is generally in the range of 5-10 Hz. By comparing the curve 505 with the curve 510, it may be observed that including reverberation signals with the "clean" speech signals tends to lower the average frequency of the amplitude modulation spectra. Put another way, the reverberation signals tend to obscure the higher-frequency components of the amplitude modulation spectrum for speech signals.

Figure 6:
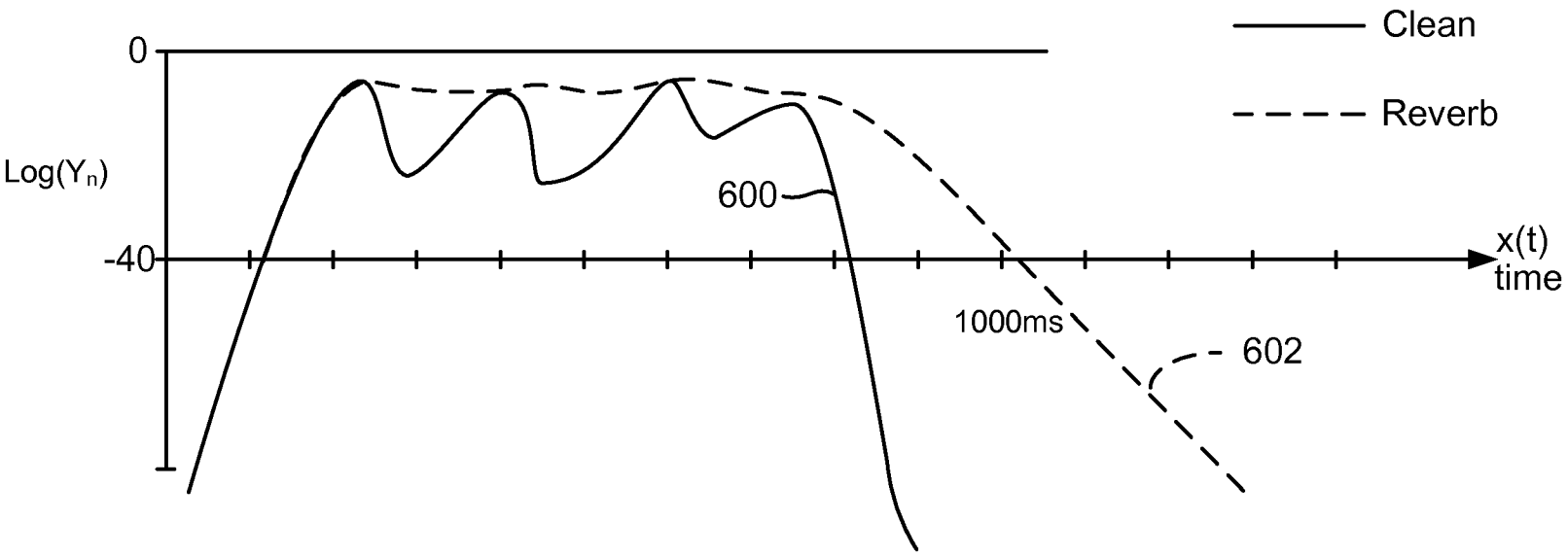
FIG. 6 is a graph of the log power of the speech signals of FIG. 2 and the log power of the combined speech and reverberation signals of FIG. 3.

The inventors have found that calculating and evaluating the log power of audio signals can further enhance the differences between clean speech signals and speech signals combined with reverberation signals. FIG. 6 is a graph of the log power of the speech signals of FIG. 2 and the log power of the combined speech and reverberation signals of FIG. 3. The log power curve 600 corresponds with the amplitude modulation curve 200*a* of the "clean" speech signal, whereas the log power curve 602 corresponds with the amplitude modulation curve 300*a* of the combined speech and reverberation signals. By comparing the log power curves 600 and 602 with the power curves 400 and 402 of FIG. 4, it may be observed that computing the log power further differentiates the clean speech signals from the speech signals combined with reverberation signals.

Figure 7:
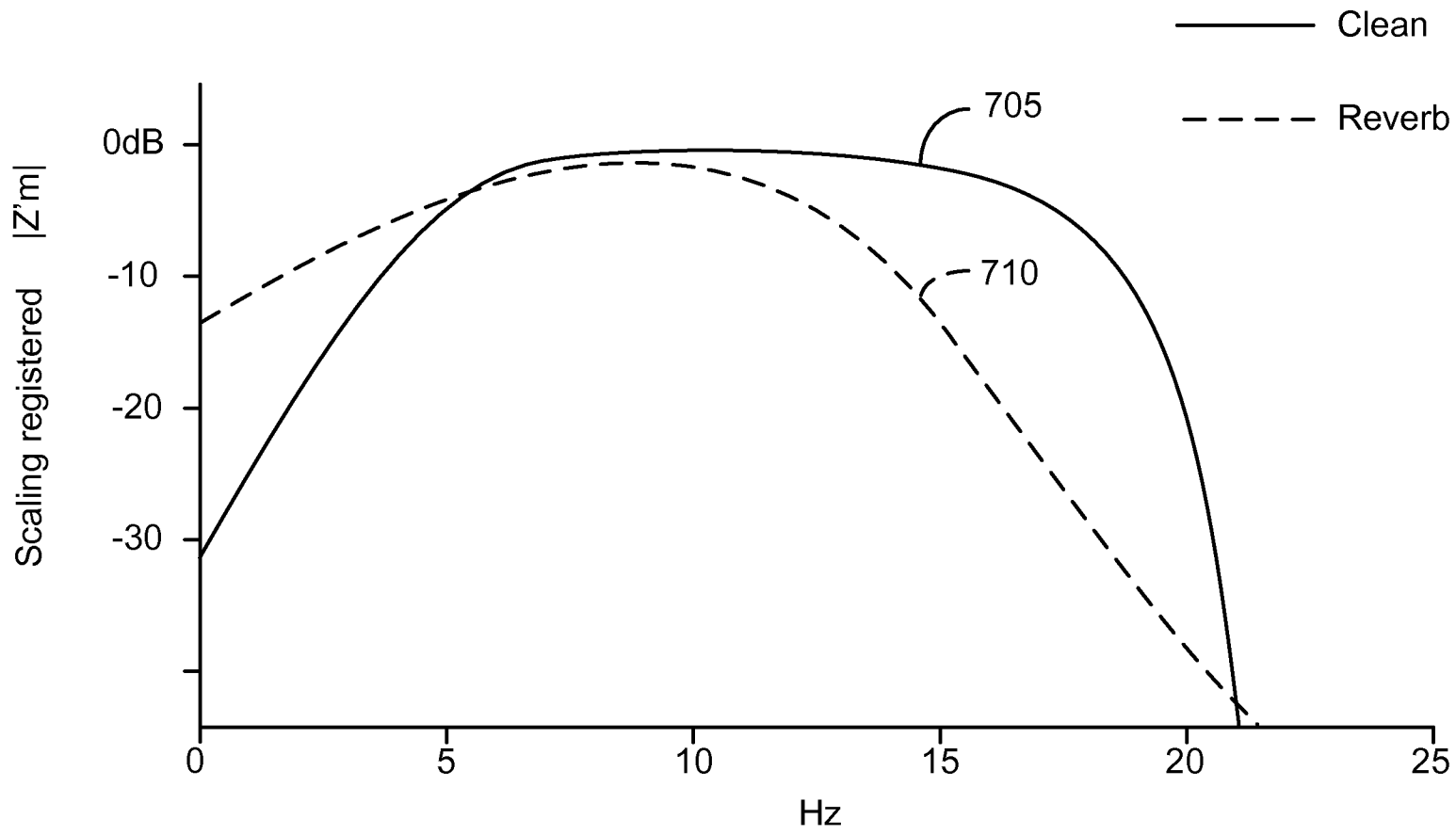
FIG. 7 is a graph that indicates the log power curves of FIG. 6 after being transformed into the frequency domain.

FIG. 7 is a graph that indicates the log power curves of FIG. 6 after being transformed into the frequency domain. In this example, the transform of the log power was computed according to the following equation:

$$Z'_m=\Sigma_{n=1}^{N}\log(Y_n)e^{-imn/N}, m=1\ldots N \quad \text{(Equation 2)}$$

In Equation 2, the base of the logarithm may vary according to the specific implementation, resulting in a change in scale according to the base selected. The curve 705 represents the frequency content of the log power curve 600, which corresponds with the amplitude modulation curve 200*a* of the clean speech signal. The curve 710 represents the frequency content of the log power curve 602, which corresponds with the amplitude modulation curve 300*a* of the combined speech and reverberation signals. Therefore, the curves 705 and 710 may be thought of as representing the frequency content of the corresponding amplitude modulation spectra.

By comparing the curve 705 with the curve 710, one may once again note that including reverberation signals with clean speech signals tends to lower the average frequency of the amplitude modulation spectra. Some audio data processing methods described herein exploit at least some of the above-noted observations for mitigating reverberation in audio data. However, various methods for mitigating reverberation that are described below involve analyzing subbands of audio data, instead of analyzing broadband audio data as described above.

Figure 8A:
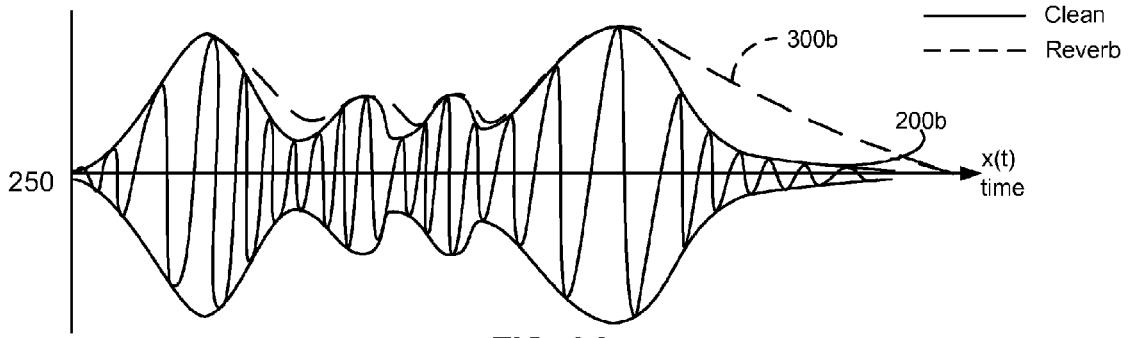
FIGS. 8A and 8B are graphs of the acoustic pressure of a low-frequency subband and a high-frequency subband of a speech signal.
Figure 8B:
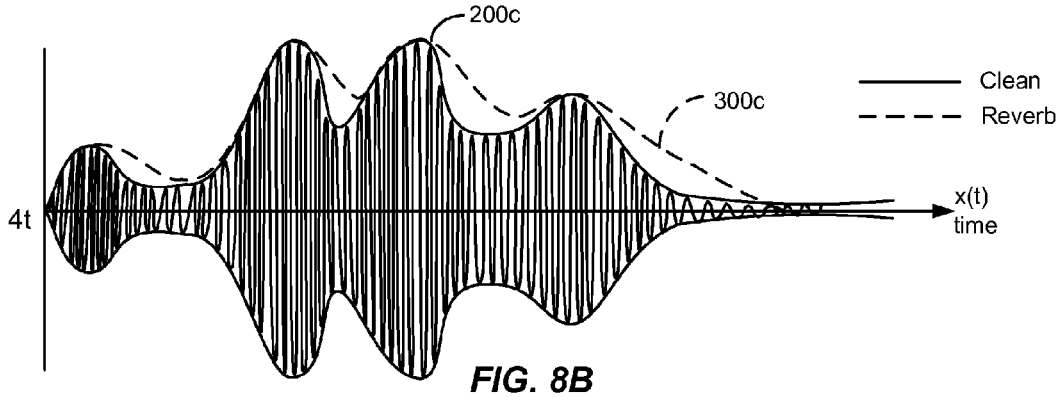

FIGS. 8A and 8B are graphs of the acoustic pressure of a low-frequency subband and a high-frequency subband of a speech signal. For example, the low-frequency subband represented in FIG. 8A may include time domain audio data in the range of 0-250 Hz, 0-500 Hz, etc. The amplitude modulation curve 200*b* represents an envelope of the amplitude of "clean" speech signals in the low-frequency subband, whereas the amplitude modulation curve 300*b* represents an envelope of the amplitude of clean speech signals and reverberation signals in the low-frequency subband. As noted above with reference to FIG. 4, adding reverberation signals to the clean speech signals makes the amplitude modulation curve 300*b* smoother than amplitude modulation curve 200*b*.

The high-frequency subband represented in FIG. 8B may include time domain audio data above 4 kHz, above 8 kHz, etc. The amplitude modulation curve 200*c* represents an envelope of the amplitude of clean speech signals in the high-frequency subband, whereas the amplitude modulation curve 300*c* represents an envelope of the amplitude of clean speech signals and reverberation signals in the high-frequency subband. Adding reverberation signals to the clean speech signals makes the amplitude modulation curve 300*c* somewhat smoother than amplitude modulation curve 200*c*, but this effect is less pronounced in the higher-frequency subband represented in FIG. 8B than in the lower-frequency subband represented in FIG. 8A. Accordingly, the effect of including reverberation energy with the pure speech signals appears to vary somewhat according to the frequency range of the subband.

The analysis of the signal and associated amplitude in the different subbands permits a suppression gain to be frequency dependent. For example, there is generally less of a requirement for reverberation suppression at higher frequencies. In general, using more than 20-30 subbands may result in diminishing returns and even in degraded functionality. The banding process may be selected to match perceptual scale, and can increase the stability of gain estimation at higher frequencies.

Although FIGS. 8A and 8B represent frequency subbands at the low and high frequency ranges of human speech, respectively, there are some similarities between the amplitude modulation curves 200*b* and 200*c*. For example, both curves have a periodicity similar to that shown in FIG. 2, which is within the normal range of speech cadence. Some implementations will now be described that exploit these similarities, as well as the differences noted above with reference to the amplitude modulation curves 300*b* and 300*c*.

Figure 9:
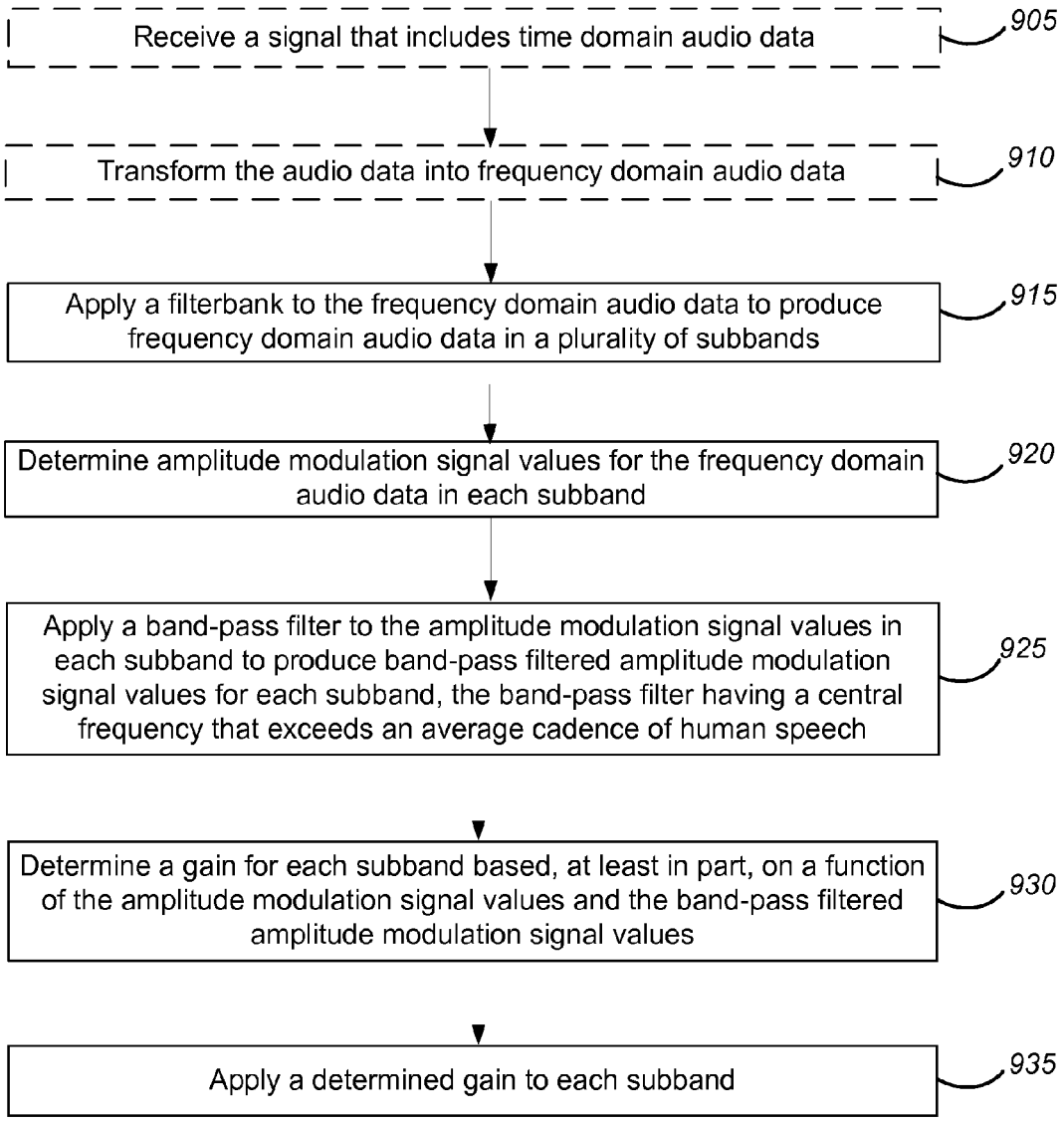
FIG. 9 is a flow diagram that outlines a process for mitigating reverberation in audio data.

FIG. 9 is a flow diagram that outlines a process for mitigating reverberation in audio data. The operations of method 900, as with other methods described herein, are not necessarily performed in the order indicated. Moreover, these methods may include more or fewer blocks than shown and/or described. These methods may be implemented, at least in part, by a logic system such as the logic system 1410 shown in FIG. 14 and described below. Such a logic system may be implemented in one or more devices, such as the devices shown and described above with reference to FIG. 1. For example, at least some of the methods described herein may be implemented, at least in part, by a teleconference phone, a desktop telephone, a computer (such as the laptop computer 135), a server (such as one or more of the servers 165), etc. Moreover, such methods may be implemented via a non-transitory medium having software stored thereon. The software may include instructions for controlling one or more devices to perform, at least in part, the methods described herein.

In this example, method 900 begins with optional block 905, which involves receiving a signal that includes time domain audio data. In optional block 910, the audio data are transformed into frequency domain audio data in this example. Blocks 905 and 910 are optional because, in some implementations, the audio data may be received as a signal that includes frequency domain audio data instead of time domain audio data.

Block 915 involves dividing the frequency domain audio data into a plurality of subbands. In this implementation, block 915 involves applying a filterbank to the frequency domain audio data to produce frequency domain audio data for a plurality of subbands. Some implementations may involve producing frequency domain audio data for a relatively small number of subbands, e.g., in the range of 5-10 subbands. Using a relatively small number of subbands can provide significantly greater computational efficiency and may still provide satisfactory mitigation of reverberation signals. However, alternative implementations may involve producing frequency domain audio data in a larger number of subbands, e.g., in the range of 10-20 subbands, 20-40 subbands, etc.

In this implementation, block 920 involves determining amplitude modulation signal values for the frequency domain audio data in each subband. For example, block 920 may involve determining power values or log power values for the frequency domain audio data in each subband, e.g., in a similar manner to the processes described above with reference to FIGS. 4 and 6 in the context of broadband audio data.

Here, block 925 involves applying a band-pass filter to the amplitude modulation signal values in each subband to produce band-pass filtered amplitude modulation signal values for each subband. In some implementations, the band-pass filter has a central frequency that exceeds an average cadence of human speech. For example, in some implementations, the band-pass filter has a central frequency in the range of 10-20 Hz. According to some such implementations, the band-pass filter has a central frequency of approximately 15 Hz. Applying band-pass filters having a central frequency that exceeds the average cadence of human speech can restore some of the faster transients in the amplitude modulation spectra.

This process may improve intelligibility and may reduce the perception of reverberation, in particular by shortening the tail of speech utterances that were previously extended by the room acoustics. The reverberant tail reduction will enhance the direct to reverberant ratio of the signal and hence will improve the speech intelligibility. As shown in the figures, the reverberation energy acts to extend or increase the amplitude of the signal in time on the trailing edge of a burst of signal energy. This extension is related to the level of reverberation, at a given frequency, in the room. Because various implementations described herein can create a gain that decreases in part during this tail section, or trailing edge, the resultant output energy may decrease relatively faster, therefore exhibiting a shorter tail.

Figure 10:
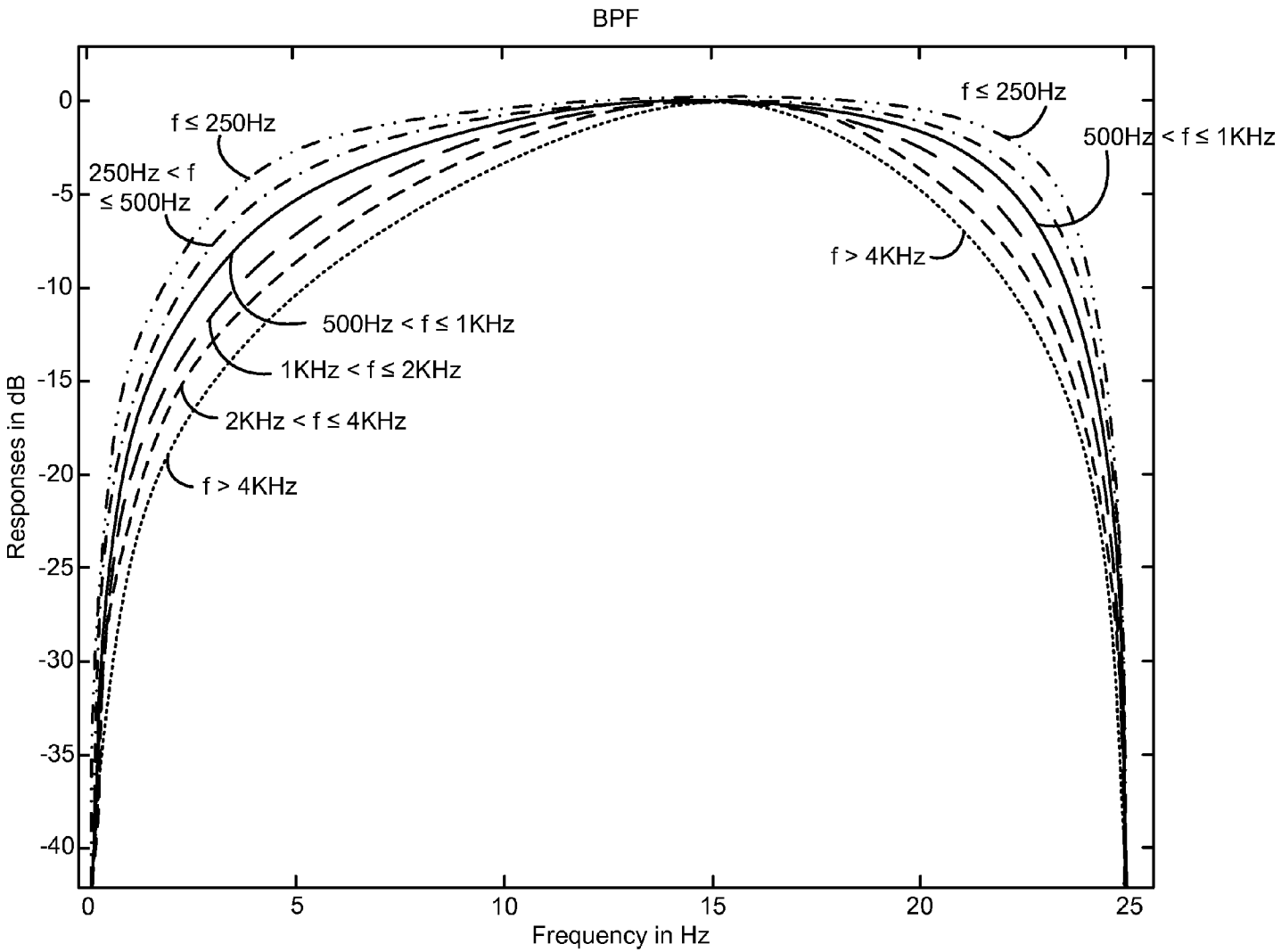
FIG. 10 shows examples of band-pass filters for a plurality of frequency bands superimposed on one another.

In some implementations, the band-pass filters applied in block 925 vary according to the subband. FIG. 10 shows examples of band-pass filters for a plurality of frequency bands superimposed on one another. In this example, frequency domain audio data for 6 subbands were produced in block 915. Here, the subbands include frequencies (f) $\leq 250$ Hz, 250 Hz$<f\leq$500 Hz, 500 Hz$<f\leq$1 kHz, 1 kHz$<f\leq$2 kHz, 2 kHz$<f\leq$4 kHz and $f>4$ kHz. In this implementation, all of the band-pass filters have a central frequency of 15 Hz. Because the curves corresponding to each filter are superimposed, one may readily observe that the band-pass filters become increasingly narrower as the subband frequencies increase. Accordingly, the band-pass filters applied in lower-frequency subbands pass a larger frequency range than the band-pass filters applied in higher-frequency subbands in this example.

Two observations regarding application to voice and room acoustics are worth noting. Lower-frequency speech content generally has slightly lower cadence, because it requires relatively more musculature to produce a lower-frequency phoneme, such as a vowel, compared to the relatively short time of a consonant. Acoustic responses of rooms tend to have longer reverberation times or tails at lower frequencies. In some implementations provided herein, it follows from the gain equations described below that greater suppression may occur at the amplitude modulation spectra regions that the band-pass filter does not pass or it attenuates the amplitude signal. Therefore, some of the filters provided herein reject or attenuate some of the lower-frequency content in the amplitude modulation signal. The upper limit of the band-pass filter is not generally critical and may vary in some embodiments. It is presented here as it leads to a convenience of design and filter characteristics.

According to some implementations, the bandwidth of the band-pass filters applied to the amplitude modulation signal are larger for the bands corresponding to input signals with a lower acoustic frequency. This design characteristic corrects for the generally lower range of amplitude modulation spectral components in the lower frequency acoustical signal. Extending this bandwidth can help to reduce artifacts that can occur in the lower formant and fundamental frequency bands, e.g., due to the reverberation suppression being too aggressive and beginning to remove or suppress the tail of audio that has resulted from a sustained phoneme. The removal of a sustained phoneme (more common for lower-frequency phonemes) is undesirable, whilst the attenuation of a sustained acoustic or reverberation component is desirable. It is difficult to resolve these two goals. Therefore the bandwidth applied to the amplitude spectra signals of the lower banded acoustic components may be tuned for the desired balance of reverb suppression and impact on voice.

In some implementations, the band-pass filters applied in block 925 are infinite impulse response (IIR) filters or other linear time-invariant filters. However, block 925 may involve applying other types of filters, such as finite impulse response (FIR) filters. Accordingly, different filtering approaches can be applied to achieve the desired amplitude modulation frequency selectivity in the filtered, banded amplitude signal. Some embodiments use an elliptical filter design, which has useful properties. For real-time implementations, the filter delay should be low or a minimum-phase design. Alternate embodiments use a filter with group delay. Such embodiments may be used, for example, if the unfiltered amplitude signal is appropriately delayed. The filter type and design is an area of potential adjustment and tuning.

Returning again to FIG. 9, block 930 involves determining a gain for each subband. In this example, the gain is based, at least in part, on a function of the amplitude modulation signal values (the unfiltered amplitude modulation signal values) and the band-pass filtered amplitude modulation signal values. In this implementation, the gains determined in block 930 are applied in each subband in block 935.

In some implementations, the function applied in block 930 includes an expression in the form of $R10^A$. According to some such implementations, R is proportional to the band-pass filtered amplitude modulation signal values divided by the unfiltered amplitude modulation signal values. In some examples, the exponent A is proportional to the amplitude modulation signal value minus the band-pass filtered amplitude modulation signal value of each sample in a subband. The exponent A may include a value (e.g., a constant) that indicates a rate of suppression.

In some implementations, the value A indicates an offset to the point at which suppression occurs. Specifically, as A is increased, it may require a higher value of the difference in the filtered and unfiltered amplitude spectra (generally corresponding to higher-intensity voice activity) in order for this term to become significant. At such an offset, this term begins to work against the suggested suppression from the first term, R. In doing so, the suggested component A can be useful to disable the activity of the reverb suppression for louder signals. This is convenient, deliberate and a significant aspect of some implementations. Louder level input signals may be associated with the onset or earlier components of speech that do not have reverberation. In particular, a sustained loud phoneme can to some extent be differentiated from a sustained room response due to differences in level. The term A introduces a component and dependence of the signal level into the reverberation suppression gain, which the inventors believe to be novel.

In some alternative implementations, the function applied in block 930 may include an expression in a different form. For example, in some such implementations the function applied in block 930 may include a base other than 10. In one such implementation, the function applied in block 930 is in the form of $R2^A$.

Determining a gain may involve determining whether to apply a gain value produced by the expression in the form of $R10^A$ or a maximum suppression value.

In one example of a gain function that includes an expression in the form of $R10^A$, the gain function g(l) is determined according to the following equation:

$$g(l) = \frac{Y_{BPF}(k, l)}{Y(k, l)} 10^{\frac{Y(k,l) - Y_{BPF}(k,l)}{\alpha}}, \quad \text{(Equation 3)}$$

$$g(l) = \max(\min(g(l), 1), \text{max suppression})$$

In Equation 3, "k" represents time and "1" corresponds to a frequency band number. Accordingly, $Y_{BPF}$ (k,l) represents band-pass filtered amplitude modulation signal values over time and frequency band numbers, and Y (k,l) represents unfiltered amplitude modulation signal values over time and frequency band numbers. In Equation 3, "α" represents a value that indicates a rate of suppression and "max suppression" represents a maximum suppression value. In some implementations, a may be a constant in the range of 0.01 to 1. In one example, "max suppression" is −9 dB.

However, these values and the particular details of Equation 3 are merely examples. For reasons of arbitrary input scaling, and typically the presence of automatic gain control in any voice system, the relative values of the amplitude modulation (Y) will be implementation-specific. In one embodiment, we may choose to have the amplitude terms Y reflect the root mean square (RMS) energy in the time domain signal. For example, the RMS energy may have been leveled such that the mean expected desired voice has an RMS of a predetermined decibel level, e.g., of around −26 dB. In this example, values of Y above −26 dB (Y>0.05) would be considered large, whilst values below −26 dB would be considered small. The offset term (alpha) may be set such that the higher-energy voice components experience less gain suppression that would otherwise be calculated from the amplitude spectra. This can be effective when the voice is leveled, and alpha is set correctly, in that the exponential term is active only during the peak or onset speech activity. This is a term that can improve the direct speech intelligibility and therefore allow a more aggressive reverb suppression term (R) to be used. As noted above, alpha may have a range from 0.01 (which reduces reverb suppression significantly for signals at or above −40 dB) to 1 (which reduces reverb suppression significantly at or above 0 dB).

In Equation 3, the operations on the unfiltered and band-pass filtered amplitude modulation signal values produce different effects. For example, a relatively higher value of Y(k,l) tends to reduce the value of g(l) because it increases the denominator of the R term. On the other hand, a relatively higher value of Y(k,l) tends to increase the value of g(l) because it increases the value of the exponent A term. One can vary $Y_{bpf}$ by modifying the filter design.

One may view the "R" and "A" terms of Equation 3 as two counter-forces. In the first term (R), a lower $Y_{bpf}$ means that there is a desire to suppress. This may happen when the amplitude modulation activity falls out of the selected band pass filter. In the second term (A), a higher Y (or $Y_{bpf}$ and $Y-Y_{bpf}$) means that there is instantaneous activity that is quite loud, so less suppression is imposed. Accordingly, in this example the first term is relative to amplitude, whereas the second is absolute.

Figure 11:
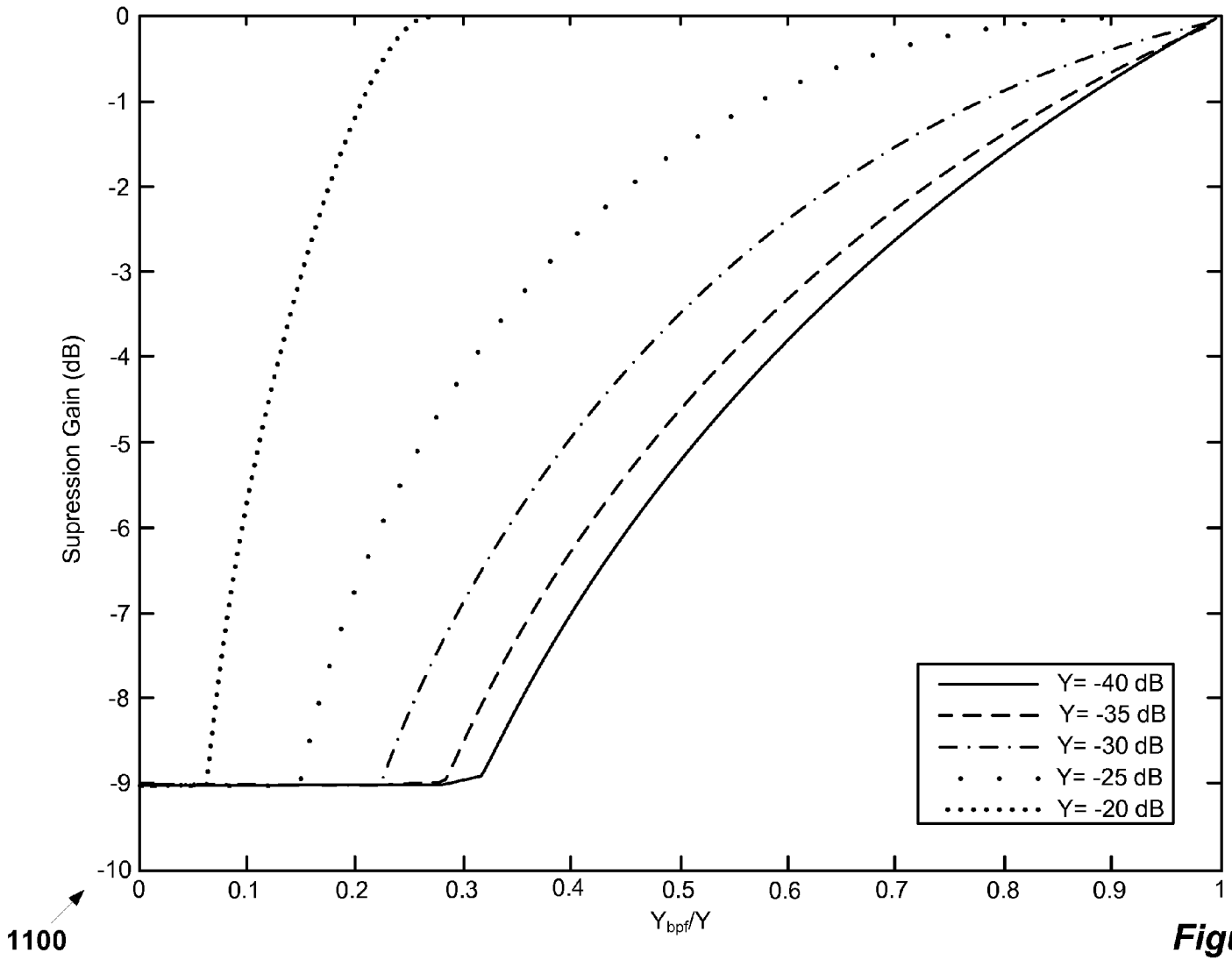
FIG. 11 is a graph that indicates gain suppression versus log power ratio of Equation 3 according to some examples.

FIG. 11 is a graph that indicates gain suppression versus log power ratio of Equation 3 according to some examples. In this example, "max suppression" is −9 dB, which may be thought of as a "floor term" of the gain suppression that may be caused by Equation 3. In this example, alpha is 0.125. Five different curves are shown in FIG. 11, corresponding to five different values of the unfiltered amplitude modulation signal values Y(k,l): −20 dB, −25 dB, −30 dB, −35 dB and −40 dB. As noted in FIG. 11, as the signal strength of Y(k,l) increases, g(l) is set to the max suppression value for an increasingly smaller range of $Y_{BPF}/Y$. For example, when Y(k,l)=−20 dB, g(l) is set to the max suppression value only when $Y_{BPF}/Y$ is in the range of zero to approximately 0.07. Moreover, for this value of Y(k,l), there is no gain suppression for values of $Y_{BPF}/Y$ that exceed approximately 0.27. As the signal strength of Y(k,l) diminishes, g(l) is set to the max suppression value for increasing values of $Y_{BPF}/Y$.

In the example shown in FIG. 11, there is a rather abrupt transition when $Y_{BPF}/Y$ increases to a level such that the max suppression value is no longer applied. In alternative implementations, this transition is smoothed. For example, in some alternative implementations there may be a gradual transition from a constant max suppression value to the suppression gain values shown in FIG. 11. In other implementations, the max suppression value may not be a constant. For example, the max suppression value may continue to decrease with decreasing values of $Y_{BPF}/Y$ (e.g., from −9 dB to −12 dB). This max suppression level may be designed to vary with frequency, because there is generally less reverberation and required attenuation at higher frequencies of acoustic input.

Various methods described herein may be implemented in conjunction with Auditory Scene Analysis (ASA). ASA involves methods for tracking various parameters of objects (e.g., people in a "scene," such as the participants 110 in the locations 105*a*-105*d* of FIG. 1). Object parameters that may be tracked according to ASA may include, but are not limited to, angle, diffusivity (how reverberant an object is) and level.

According to some such implementations, the use of diffusivity and level can be used to adjust various parameters used for mitigating reverberation in audio data. For example, if the diffusivity is a parameter between 0 and 1, where 0 is no reverberation and 1 is highly reverberant, then knowing the specific diffusivity characteristics of an object can be used to adjust the "max suppression" term of Equation 3 (or a similar equation).

Figure 12:
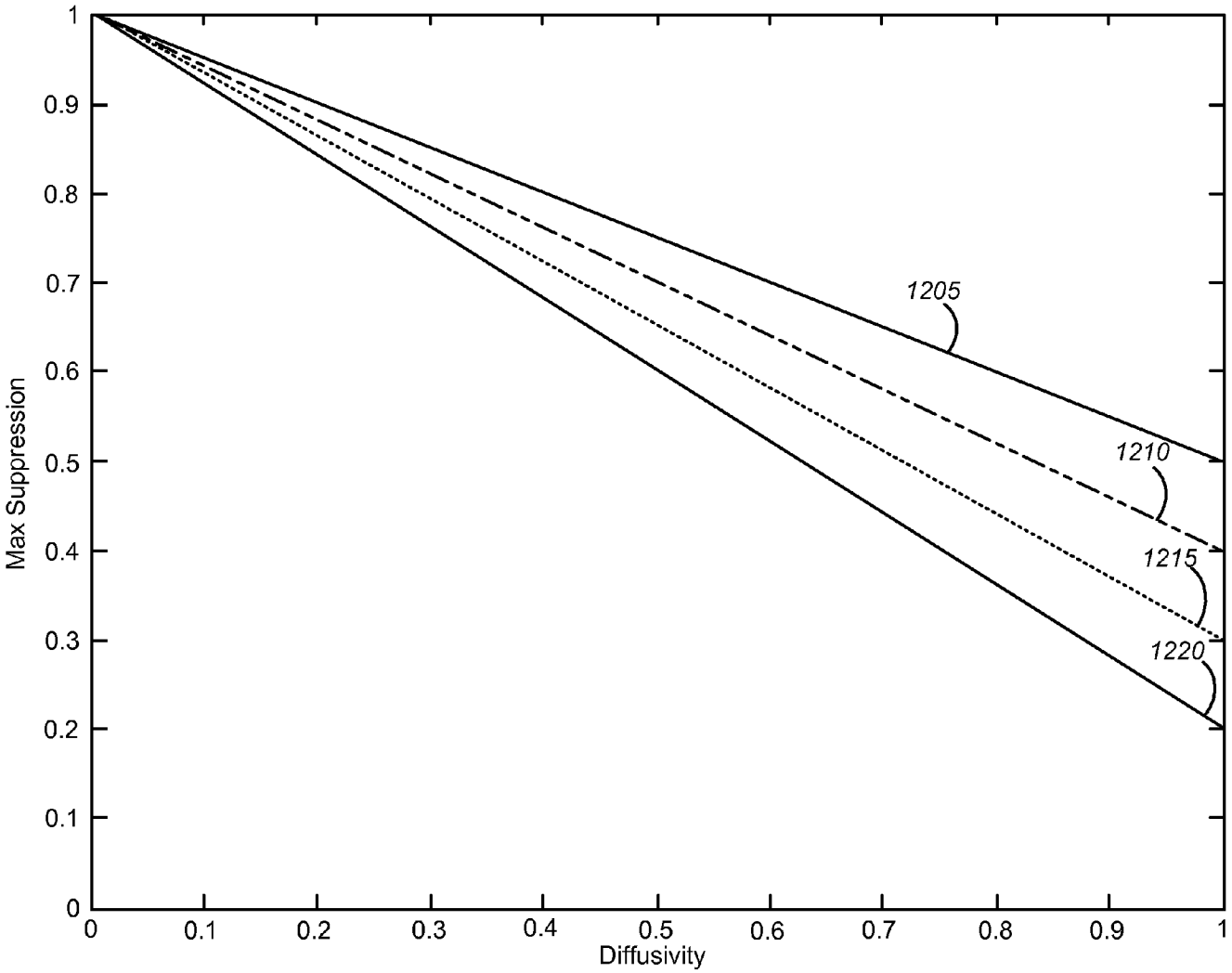
FIG. 12 is a graph that shows various examples of max suppression versus diffusivity plots.

FIG. 12 is a graph that shows various examples of max suppression versus diffusivity plots. In this example, max suppression is in a linear form such that in decibels, a max suppression value range of 1 to 0, corresponds to 0 to −infinity, as shown in Equation 4:

$$\text{MaxSuppression_dB}=20*\log_{10}(\text{max suppression}). \quad \text{(Equation 4)}$$

In the implementations shown in FIG. 12, higher values of max suppression are allowed for increasingly diffuse objects. Accordingly, in these examples max suppression may have a range of values instead of being a fixed value. In some such implementations, max suppression may be determined according to Equation 5:

$$\text{max suppression}=1-\text{diffusivity}(1-\text{lowest_suppression}) \quad \text{(Equation5)}$$

In Equation 5, "lowest_suppression" represents the lower bound of the max suppression allowable. In the example shown in FIG. 12, the lines 1205, 1210, 1215 and 1220 correspond to lowest_suppression values of 0.5, 0.4, 0.3 and 0.2, respectively. In these examples, relatively higher max suppression values are determined for relatively more diffuse objects.

Furthermore, the degree of suppression (also referred to as "suppression depth") also may govern the extent to which an object is levelled. Highly reverberant speech is often related to both the reflectivity characteristics of a room as well as distance. Generally speaking, we perceive highly reverberant speech as a person speaking from a further distance and we have an expectation that the speech level will be softer due to the attenuation of level as a function of distance. Artificially raising the level of a distant talker to be equal to a near talker can have perceptually jarring ramifications, so reducing the target level slightly based on the suppression depth of the reverberation suppression can aid in creating a more perceptually consistent experience. Therefore, in some implementations, the greater the suppression, the lower the target level.

In a general sense, we may choose to apply more reverberation to lower-level signals and use longer-term information to effect this. This may be in addition to the "A" term in the general expression that produces a more immediate effect. Because speech that is lower-level input may be boosted to a constant level prior to the reverb suppression, this approach of using the longer-term context to control the reverb suppression can help to avoid unnecessary or insufficient reverberation suppression on changing voice objects in a given room.

Figure 13:
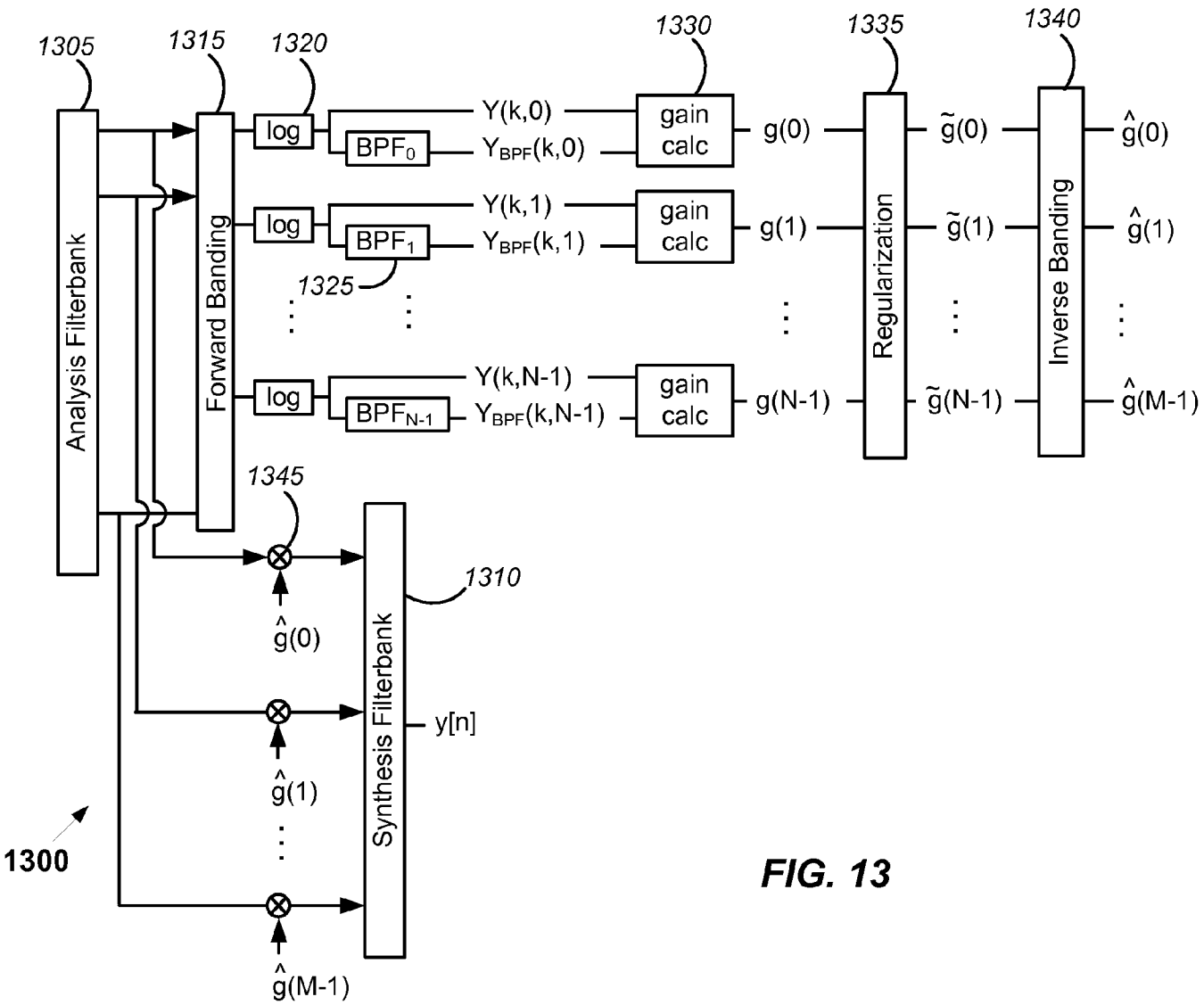
FIG. 13 is a block diagram that provides examples of components of an audio processing apparatus capable of mitigating reverberation.

FIG. 13 is a block diagram that provides examples of components of an audio processing apparatus capable of mitigating reverberation. In this example, the analysis filterbank 1305 is configured to decompose input audio data into frequency domain audio data of M frequency subbands. Here, the synthesis filterbank 1310 is configured to reconstruct the audio data of the M frequency subbands into the output signal y[n] after the other components of the audio processing system 1300 have performed the operations indicated in FIG. 13. Elements 1315-1345 may be configured to provide at least some of the reverberation mitigation functionality described herein. Accordingly, in some implementations the analysis filterbank 1305 and the synthesis filterbank 1310 may, for example, be components of a legacy audio processing system.

In this example, the forward banding block 1315 is configured to receive the frequency domain audio data of M frequency subbands output from the analysis filterbank 1305 and to output frequency domain audio data of N frequency subbands. In some implementations, the forward banding block 1315 may be configured to perform at least some of the processes of block 915 of FIG. 9. N may be less than M. In some implementations, N may be substantially less than M. As noted above, N may be in the range of 5-10 subbands in some implementations, whereas M may be in the range of 100-2000 and depends on the input sampling frequency and transform block rate. A particular embodiment uses a 20 ms block rate at a 32 kHz sampling rate, producing 640 specific frequency terms or bins created at each time instant (the raw FFT coefficient cardinality). Some such implementations group these bins into a smaller number of perceptual bands, e.g., in the range of 45-60 bands.

As noted above, N may be in the range of 5-10 subbands in some implementations. This may be advantageous, because such implementations may involve performing reverberation mitigation processes on substantially fewer subbands, thereby decreasing computational overhead and increasing processing speed and efficiency.

In this implementation, the log power blocks 1320 are configured to determine amplitude modulation signal values for the frequency domain audio data in each subband, e.g., as described above with reference to block 920 of FIG. 9. The log power blocks 1320 output Y(k,l) values for subbands 0 through N−1. The Y(k,l) values are log power values in this example.

Here, the band-pass filters 1325 are configured to receive the Y(k,l) values for subbands 0 through N−1 and to perform band-pass filtering operations such as those described above with reference to block 925 of FIG. 9 and/or FIG. 10. Accordingly, the band-pass filters 1325 output $Y_{BPF}(k,l)$ values for subbands 0 through N−1.

In this implementation, the gain calculating blocks 1330 are configured to receive the Y(k,l) values and the $Y_{BPF}(k,l)$ values for subbands 0 through N−1 and to determine a gain for each subband. The gain calculating blocks 1330 may, for example, be configured to determine a gain for each subband according to processes such as those described above with reference to block 930 of FIG. 9, FIG. 11 and/or FIG. 12. In this example, the regularization block 1335 is configured for applying a smoothing function to the gain values for each subband that are output from the gain calculating blocks 1330.

In this implementation, the gains will ultimately be applied to the frequency domain audio data of the M subbands output by the analysis filterbank 1305. Therefore, in this example the inverse banding block 1340 is configured to receive the smoothed gain values for each of the N subbands that are output from the regularization block 1335 and to output smoothed gain values for M subbands. Here, the gain applying modules 1345 are configured to apply the smoothed gain values, output by the inverse banding block 1340, to the frequency domain audio data of the M subbands that are output by the analysis filterbank 1305. Here, the synthesis filterbank 1310 is configured to reconstruct the audio data of the M frequency subbands, with gain values modified by the gain applying modules 1345, into the output signal y[n].

Figure 14:
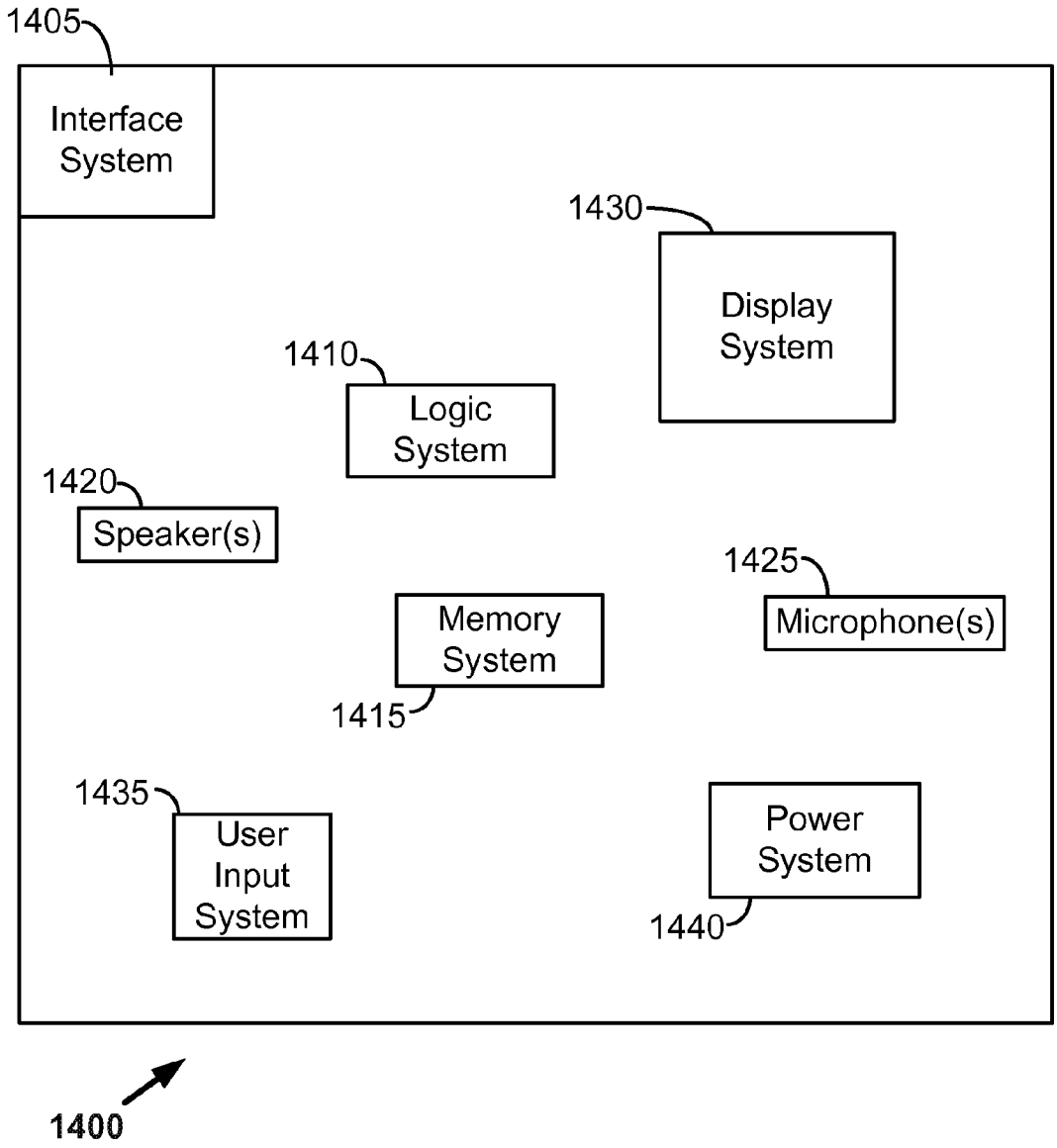
FIG. 14 is a block diagram that provides examples of components of an audio processing apparatus.

FIG. 14 is a block diagram that provides examples of components of an audio processing apparatus. In this example, the device 1400 includes an interface system 1405. The interface system 1405 may include a network interface, such as a wireless network interface. Alternatively, or additionally, the interface system 1405 may include a universal serial bus (USB) interface or another such interface.

The device 1400 includes a logic system 1410. The logic system 1410 may include a processor, such as a general purpose single- or multi-chip processor. The logic system 1410 may include a digital signal processor (DSP), an application specific integrated circuit (ASIC), a field programmable gate array (FPGA) or other programmable logic device, discrete gate or transistor logic, or discrete hardware components, or combinations thereof. The logic system 1410 may be configured to control the other components of the device 1400. Although no interfaces between the components of the device 1400 are shown in FIG. 14, the logic system 1410 may be configured with interfaces for communication with the other components. The other components may or may not be configured for communication with one another, as appropriate.

The logic system 1410 may be configured to perform audio processing functionality, including but not limited to the reverberation mitigation functionality described herein. In some such implementations, the logic system 1410 may be configured to operate (at least in part) according to software stored one or more non-transitory media. The non-transitory media may include memory associated with the logic system 1410, such as random access memory (RAM) and/or read-only memory (ROM). The non-transitory media may include memory of the memory system 1415. The memory system 1415 may include one or more suitable types of non-transitory storage media, such as flash memory, a hard drive, etc.

The display system 1430 may include one or more suitable types of display, depending on the manifestation of the device 1400. For example, the display system 1430 may include a liquid crystal display, a plasma display, a bistable display, etc.

The user input system 1435 may include one or more devices configured to accept input from a user. In some implementations, the user input system 1435 may include a touch screen that overlays a display of the display system 1430. The user input system 1435 may include a mouse, a track ball, a gesture detection system, a joystick, one or more GUIs and/or menus presented on the display system 1430, buttons, a keyboard, switches, etc. In some implementations, the user input system 1435 may include the microphone 1425: a user may provide voice commands for the device 1400 via the microphone 1425. The logic system may be configured for speech recognition and for controlling at least some operations of the device 1400 according to such voice commands.

The power system 1440 may include one or more suitable energy storage devices, such as a nickel-cadmium battery or a lithium-ion battery. The power system 1440 may be configured to receive power from an electrical outlet.

Various modifications to the implementations described in this disclosure may be readily apparent to those having ordinary skill in the art. The general principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

What is claimed is:

1. A method, comprising:

receiving a signal that includes frequency domain audio data;

applying a filterbank to the frequency domain audio data to produce frequency domain audio data in a plurality of subbands;

determining amplitude modulation signal values for the frequency domain audio data in each subband;

applying a band-pass filter to the amplitude modulation signal values in each subband to produce band-pass filtered amplitude modulation signal values for each subband, the band-pass filter having a central frequency that exceeds an average cadence of human speech;

determining a gain for each subband based, at least in part, on a function of the amplitude modulation signal values and the band-pass filtered amplitude modulation signal values; and applying a determined gain to each subband.

2. The method of claim 1, wherein the process of determining amplitude modulation signal values involves determining log power values for the frequency domain audio data in each subband.

3. The method of claim 1, wherein a band-pass filter for a lower-frequency subband passes a larger frequency range than a band-pass filter for a higher-frequency subband.

4. The method of claim 1, wherein the band-pass filter for each subband has a central frequency in the range of 10-20 Hz.

5. The method of claim 4, wherein the band-pass filter for each subband has a central frequency of approximately 15 Hz.

6. The method of claim 1, wherein the function includes an expression in the form of $R10^{A}$.

7. The method of claim 6, wherein R is proportional to a band-pass filtered amplitude modulation signal value divided by an amplitude modulation signal value.

8. The method of claim 6, wherein A is proportional to an amplitude modulation signal value minus a band-pass filtered amplitude modulation signal value.

9. A non-transitory medium having software stored thereon, the software including instructions for controlling at least one apparatus to perform the method of claim 1.

10. A device, comprising:

an interface system; and a logic system configured to receive, via the interface system, a signal that includes frequency domain audio data;

apply a filterbank to the frequency domain audio data to produce frequency domain audio data in a plurality of subbands;

determine amplitude modulation signal values for the frequency domain audio data in each subband;

apply a band-pass filter to the amplitude modulation signal values in each subband to produce band-pass filtered amplitude modulation signal values for each subband, the band-pass filter having a central frequency that exceeds an average cadence of human speech;

determine a gain for each subband based, at least in part, on a function of the amplitude modulation signal values and the band-pass filtered amplitude modulation signal values; and apply a determined gain to each subband.

11. The device of claim 10, wherein the process of determining amplitude modulation signal values involves determining log power values for the frequency domain audio data in each subband.

12. The device of claim 10, wherein a band-pass filter for a lower-frequency subband passes a larger frequency range than a band-pass filter for a higher-frequency subband.

13. The device of any one of claim 10, wherein the band-pass filter for each subband has a central frequency in the range of 10-20 Hz.

14. The device of claim 13, wherein the band-pass filter for each subband has a central frequency of approximately 15 Hz.

15. The device of claim 10, wherein the function includes an expression in the form of $R10^{A}$.

16. The device of claim 15, wherein R is proportional to a band-pass filtered amplitude modulation signal value divided by an amplitude modulation signal value.

17. The device of claim 15, wherein A is proportional to an amplitude modulation signal value minus a band-pass filtered amplitude modulation signal value.

18. The device of claim 15, wherein A includes a constant that indicates a rate of suppression.

19. The device of claim 15, wherein determining the gain involves determining whether to apply a gain value produced by the expression in the form of $R10^{A}$ or a maximum suppression value.

20. The device of claim 10, wherein the logic system is further configured to determine a diffusivity of an object; and determine the maximum suppression value for the object based, at least in part, on the diffusivity.

* * * * *